US007329160B2

(12) United States Patent
Grimmeisen

(10) Patent No.: US 7,329,160 B2
(45) Date of Patent: Feb. 12, 2008

(54) MOTORIZED WATERCRAFT

(76) Inventor: Andrea Grimmeisen, Weiner Str. 193, DB-70409, Stüttgart (DE)

( * ) Notice: Subject to any disclaimer, the term of this patent is extended or adjusted under 35 U.S.C. 154(b) by 179 days.

(21) Appl. No.: 10/983,335

(22) Filed: Nov. 5, 2004

(65) Prior Publication Data

US 2005/0181686 A1 Aug. 18, 2005

Related U.S. Application Data

(63) Continuation-in-part of application No. 10/765,351, filed on Jan. 27, 2004, now abandoned, which is a continuation of application No. 10/009,626, filed on Apr. 1, 2002, now Pat. No. 6,682,372.

(51) Int. Cl.

| | |
|---|---|
| ***B63H 21/17*** | (2006.01) |
| ***B63H 11/00*** | (2006.01) |
| ***B63C 11/46*** | (2006.01) |
| ***A63B 35/12*** | (2006.01) |
| ***B63B 35/73*** | (2006.01) |

(52) U.S. Cl. ..... 440/6; 440/38; 114/315; 114/55.56; 114/55.58

(58) Field of Classification Search ..... 114/312, 114/315, 337, 338, 55.5, 55.56, 55.58; 440/6, 440/7, 38

See application file for complete search history.

(56) References Cited

U.S. PATENT DOCUMENTS

| | | | | |
|---|---|---|---|---|
| 2,722,021 | A * | 11/1955 | Keogh-Dwyer | 114/315 |
| 3,329,118 | A | 7/1967 | Strader | |
| 3,408,976 | A | 11/1968 | Ellis | |
| 3,543,712 | A | 12/1970 | Vasilatos | |
| 3,716,013 | A | 2/1973 | Vasilatos | |
| 3,789,788 | A * | 2/1974 | Peroni | 114/315 |
| 4,027,617 | A * | 6/1977 | Ikeda et al. | 440/46 |
| D289,031 | S | 3/1987 | Monostory | |
| D307,258 | S | 4/1990 | Monostory | |
| 4,929,200 | A * | 5/1990 | Guezou et al. | 440/38 |
| 5,017,166 | A | 5/1991 | Chang | |
| 5,090,929 | A | 2/1992 | Rieben | |
| 5,105,753 | A | 4/1992 | Chih et al. | |
| 5,158,034 | A | 10/1992 | Hsu | |
| 5,379,714 | A | 1/1995 | Lewis et al. | |
| 5,399,111 | A | 3/1995 | Kobayashi et al. | |
| 5,433,164 | A | 7/1995 | Sneath | |

(Continued)

FOREIGN PATENT DOCUMENTS

| | | |
|---|---|---|
| DE | 35 23 758 A1 | 1/1987 |
| DE | 35 13 515 A1 | 10/1988 |
| EP | 816 222 | 1/1998 |

(Continued)

*Primary Examiner*—Ajay Vasudeva
(74) *Attorney, Agent, or Firm*—Pauley Petersen & Erickson

(57) ABSTRACT

A motorized watercraft with a hull of the craft on which a user lies prone, at least partially, or stands up, with a flow channel extending in the hull of the craft with an electric motor-driven water screw. The electric motor and the batteries, as well as the control device for the electric motor and the water screw are housed, at least partially, in the flow channel in the hull of the craft. A clear increase in efficiency can be attained in connection with the motorized watercraft if a flow stator is arranged in the flow channel of the water screw, upstream, or preferably downstream, in the flow direction, which at least partially straightens the rotating water flow generated in the flow channel.

40 Claims, 2 Drawing Sheets

U.S. PATENT DOCUMENTS

| | | | | |
|---|---|---|---|---|
| 5,462,460 | A * | 10/1995 | Kobaysahi | 440/6 |
| 5,469,803 | A | 11/1995 | Gallo | |
| 5,704,817 | A | 1/1998 | Vaughn | |
| 5,878,687 | A | 3/1999 | Grimmeisen | |
| 6,036,555 | A | 3/2000 | Takacs | |
| 6,311,631 | B1 | 11/2001 | Beecher | |
| 6,325,683 | B1 | 12/2001 | Yocom | |
| 6,409,560 | B1 | 6/2002 | Austin | |
| 6,461,204 | B1 | 10/2002 | Takura et al. | |
| 6,615,761 | B2 | 9/2003 | Wyman | |

FOREIGN PATENT DOCUMENTS

| | | | |
|---|---|---|---|
| JP | 05058388 | A | 3/1993 |
| JP | 05- 178268 | A | 7/1993 |
| JP | 08-239090 | | 9/1996 |
| JP | 2001-225794 | | 8/2001 |
| JP | 2002362488 | A * | 12/2002 |
| WO | 92/00124 | | 1/1992 |
| WO | 96/30087 | | 10/1996 |

* cited by examiner

MOTORIZED WATERCRAFT

This is a continuation-in-part patent application and claims the benefit of priority of U.S. patent application having Ser. No. 10/765,351, filed on 27 Jan. 2004, now abandoned, which is a continuation patent application of U.S. patent application having Ser. No. 10/009,626, filed on 01 Apr. 2002, now U.S. Pat. No. 6,682,372 B2, the entire disclosures of which are incorporated by reference into this patent application.

BACKGROUND OF THE INVENTION

1. Field of the Invention

This invention relates to a motorized watercraft with a hull of the craft, on which the user lies prone, at least partially, or stands up, with a flow channel extending in the hull of the craft with an electric motor-driven water screw, wherein the electric motor and the batteries, as well as the control device for the electric motor and the water screw are housed, at least partially, in the flow channel in the hull of the craft.

2. Discussion of Related Art

A motorized watercraft of this type is known from PCT International Publication WO 96/30087. There, the user lies prone on the hull of the craft, and the water screw in the flow channel is driven by a battery-powered electric motor so that a water flow, which extends opposite the movement direction of the motorized watercraft, is aspirated through the flow channel.

Thus the water flow can be kept away from the user, and the flow of the channel water can also be conducted past the user by the shape of the hull of the watercraft. This makes swimming and diving by the motorized watercraft easier.

The design of the structure of the motorized watercraft is complicated and is not user-friendly with respect to maintenance. The electric motor is connected to the water screw by a gear. The electric motor in the interior of the hull of the craft is cooled to maintain its power delivery. The output of such a motorized watercraft is relatively limited. Also, because of its complex structure the motorized watercraft is very heavy and therefore difficult to handle.

SUMMARY OF THE INVENTION

It is one object of this invention to provide a motorized watercraft of the type mentioned above but which has a large degree of efficiency.

The above object of this invention is achieved with a flow stator, having guide vanes, that is arranged in the flow channel of the water screw, upstream, or preferably downstream, in the flow direction, which straightens the rotating water flow generated in the flow channel, at least partially.

The flow stator absorbs the rotatory movement of the water accelerated by the water screw and converts it into an additional propelling force. The generated stream of water impacts the surrounding water without a propelling-reducing, spirally shaped rotatory flow, which results in an effective, highly efficient operation.

Preferably, the flow stator is directly connected with the hull of the craft and fixed in place.

A simple construction of the flow stator results if the flow stator has a plurality of guide vanes, which are concentrically arranged in the flow channel. The guide vanes can be arranged around a cone in a manner which favors the flow.

For achieving an optimal acceleration of the water moving in the flow channel, the flow stator is arranged in the area of or near a water outlet nozzle or diffusor, having a cross section that is tapered, of the flow channel.

In connection with a motorized watercraft in accordance with this embodiment it is possible to assure a lasting operation with a high degree of efficiency even when the batteries are placed into a waterproof housing and are in heat-conducting contact with the housing, at least partially. The housing is of a heat-conductive material, at least partially, and the housing is in a heat-conducting contact with the flowing water. As used throughout this specification and in the claims, the term storage batteries is also understood to include the term batteries.

It is possible to dependably transfer heat generation in the batteries inevitably arising with electric motors of high output to the water in a simple manner, which is available as a practically unlimited cooling reservoir.

For satisfactory heat transfer to the water, the housing can be made at least partially of aluminum. The aluminum material is preferably sufficiently corrosion-resistant, in particular to seawater. To remain sufficiently safe for the user in case of damage, in accordance with one embodiment of this invention, the batteries have a voltage of less than or equal to 60 V. In this case, cooling in accordance with this invention is particularly suitable for the removal of the arising heat, as explained in the following example.

With 4 kW output at the driveshaft and total efficiency of the drive system (90% motor+5% electronic devices=85% total) of approximately 85%, this provides a 4.7 kW output from the batteries. At 45 V over 100 A of a possible continuous current flow, the total system is heated. Thus, rather than the high degree of technical efficiency attained, it is necessary to provide good cooling, such as of 700 W.

A further design in accordance with this invention can be distinguished because the housing with the batteries is arranged at least partially in the area of or near the flow channel. A large flow volume of cooling water exists in this area, which aids efficient cooling.

In accordance with a further preferred embodiment of this invention, the housing with the batteries can be arranged in a recess formed on the underside of the hull of the craft arranged, at least partially, outside of the flow channel and of the inflow opening of the flow channel, and the housing can be partially arranged in flowing water on at least the port and starboard side and/or the keel. With this arrangement a water flow over large areas is possible. The equalization of the weight of the motorized watercraft in view of the optimal center of gravity can be easily aided with the housing extending around the center area of the hull of the vehicle formed between the bow and the stern, in the direction toward the bow.

The batteries are easily accessible for the charging process, or can be taken out and replaced by a new housing with charged batteries. With this the motorized watercraft can be used in a user-friendly way, which is of particular advantage for rental operations. The housing for the batteries is waterproof and preferably also has a waterproof charging jack.

In a motorized watercraft in accordance with one embodiment of this invention, a lasting operation with a high degree of efficiency can be assured if the electric motor is designed as an internal rotor motor, the stator of the electric motor is in heat-conducting contact with a receiving housing containing the electric motor via a heat-conducting unit, the receiving housing is at least partially of a heat-conductive material in the area assigned to the heat-conducting unit and the receiving housing is arranged at least partially in the flow channel.

An electric motor designed in this way can dependably release its heat to the flowing water. Thus the capability of conducting heat provides the unequivocal and rapid removal of heat. With this arrangement it is also possible to omit additional cooling devices, which considerably reduces the outlay costs for parts of the motorized craft. Also, the electronic control device which has the electronic switching device and possibly power elements can be cooled by water if needed.

The electronic device and the motor preferably form a unit, and the units can be thermally coupled, if desired.

In one embodiment of this invention, the heat-conducting unit is designed as a heat-conducting casting compound, which is connected with the receiving housing by material contact. A good heat transmission between the stator and the receiving housing of the electric motor is thus created.

For converting the electric motor to different power stages in a simple way, the housing of the electric motor forms a stator receiver, in which different stators in the form of structural components can be installed, wherein the stators have different lengths in the axial direction of the driveshaft of the rotor in accordance with different power ranges.

Dependable sealing of the receiving housing is achieved because the rotor and the stator are placed in the receiving housing which is closed watertight with respect to its environment. The driveshaft extends out of the receiver housing through a sealing cassette. The sealing cassette seals the driveshaft by at least two sealing rings. The sealing cassette can be placed, displaceable in the axial direction, into different mounting positions with respect to the driveshaft. The displaceable sealing cassette makes it possible to assign the sealing rings to different areas of the shaft. This becomes necessary after the sealing rings have worked themselves into the surface of the driveshaft after a certain operating time and the danger of a leak then occurs.

The service life of the driveshaft can be increased because the running surface of the driveshaft on which the sealing rings run off is tempered, for example coated with a hard material. Simple monitoring for leaks is possible by arranging a leak sensor between two sealing rings, or preferably downstream of the redundant sealing rings.

In accordance with this invention, it is possible to combine the water screw, electric motor and control device for the electric motor into an underwater unit and to place the latter into the flow channel.

This results in a considerable simplification of the structure of the parts, in particular of the hull of the vehicle, and of the maintenance of the motorized watercraft.

If in one embodiment the hull of the craft has a surface for prone use, or a platform for the user above the flow channel, it can be used in two ways of employment.

The construction can be further simplified by forming the flow channel in one piece with the hull of the craft.

In one embodiment, the flow channel starts with an inflow opening in the area of the bow of the hull of the craft, and terminates in an outflow opening in the area of the stern of the hull of the craft, and the underwater drive unit is installed in the flow channel as a propelling and suction device.

One embodiment is advantageous for the two different types of employment of the motorized watercraft while in the prone or standing position, which is distinguished because a remote control device is assigned to the underwater drive unit, which is releasably attached to the hull of the craft and can be brought into operative contact with the control device of the underwater unit over a wireless transmission path.

For a simple maintenance or repair of the underwater drive unit, the hull of the craft has a plate, flap or the like which can be opened, in the flow channel below the underwater drive unit, through which access to the underwater unit is provided.

BRIEF DESCRIPTION OF THE DRAWINGS

This invention is explained in greater detail in view of exemplary embodiments of a motorized watercraft represented in the drawings, wherein.

DESCRIPTION OF PREFERRED EMBODIMENTS

Figure 1:
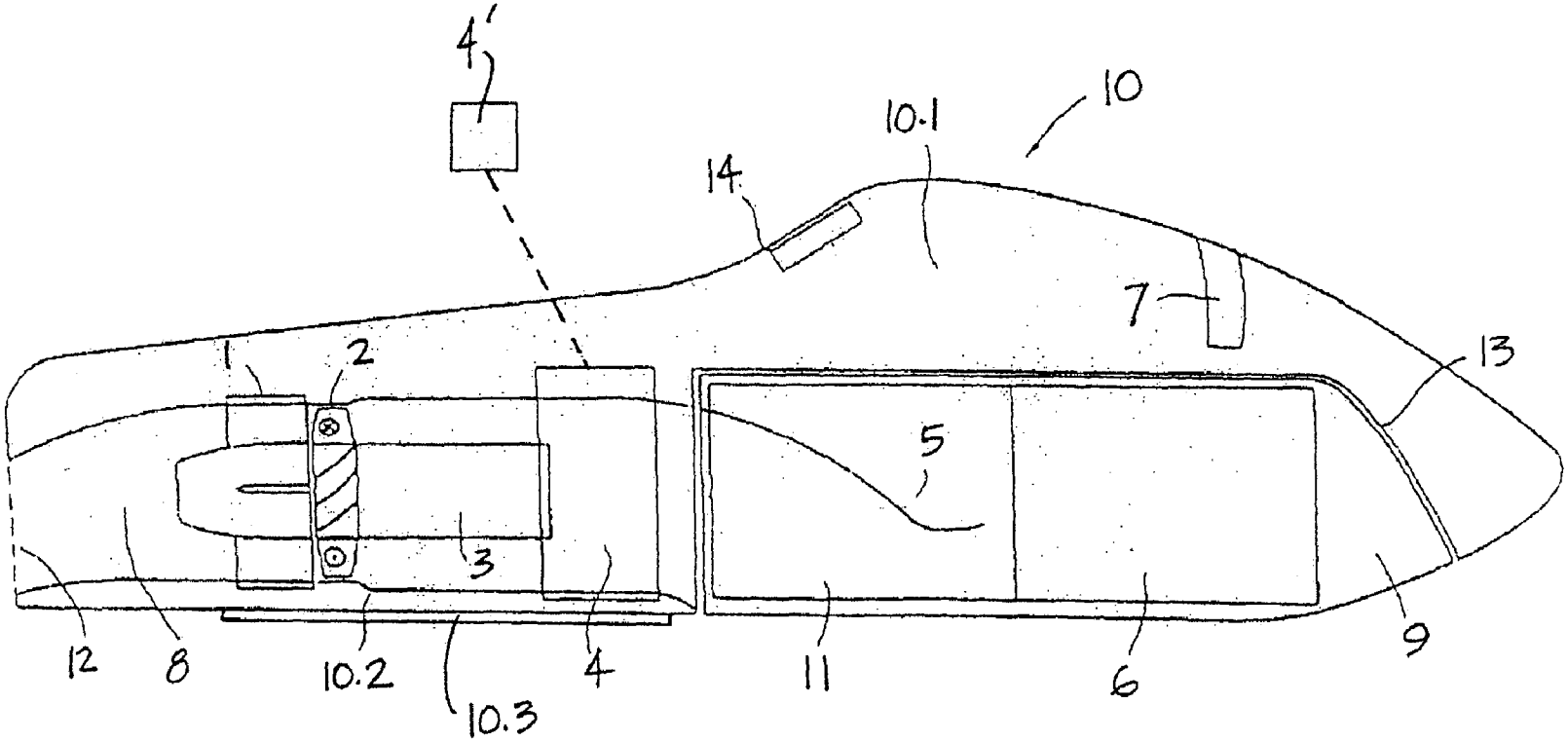
FIG. 1 is a side view of the motorized watercraft.

The exterior shape of the hull 10 of the craft essentially corresponds to the exterior shape of the hull of the motorized watercraft known from PCT International Publication WO 96/30087. The flow channel 8 extends from the inflow opening 11 in the area of the bow to the flow outlet 12 in the area of the stern of the hull 10 of the craft. Therefore the inflow opening 11 extends, starting from a center area of the hull 10 of the craft, in the direction toward the bow. An underwater drive unit comprising a flow stator 1, an electric motor 3, a water screw 2 and the motor control device 4 is installed in the flow channel 8, which is slightly downward curved in the area of or near the inflow opening 11 and the outflow opening 12. In this case, the flow stator is in stationary connection with the hull 10 of the craft and it has a function that straightens the rotating water flow generated in the flow channel 8 so that it is as free as possible of torsion or torsional forces. An increase in efficiency is thus achieved. The motorized watercraft can be designed so that it can be used in flowing water without problems. Thus the hull 10 can be freely designed outside of the flow channel 8 and can be designed as simply as possible, but as well as possible for advantageous flow and user-friendliness.

The flow channel can be formed in one piece with the hull 10 of the craft. In the present exemplary embodiment, the flow channel 8 is formed by an upper shell 10.1 and a lower shell 10.2. The components are connected with each other by a suitable fastener or fastening means. The flow channel 8 is accessible for maintenance of the underwater drive unit by removing the lower shell 10.2. But a plate 10.3, flap, or the like can be provided below the underwater drive unit, by which an access to the underwater drive unit exists.

A recess 13 is formed in the underside in the area of the bow of the upper shell 10.1 of the hull 10, into which a housing 9 with batteries 5 and 6 is releasably inserted. The housing 9 with the chargeable batteries 5 and 6 can be easily and rapidly exchanged and can be replaced by a housing 9 with charged batteries 5 and 6, so that the motorized watercraft is always ready for use.

The area of the inflow opening 11 of the flow channel 8 is covered at the top by the housing 9 so that easy access to the rotor 2 is prevented, but water can be conveyed at a sufficient flow volume. With this simple step the rotor 2 is only accessible when the housing 9 is removed, for example when the electric motor 3 is currentless.

Also access to the flow channel 8 can be prevented by a blocking element or blocking means which are arranged in the area of the inflow and/or outflow opening.

Along its two sides, port and starboard, and along the keel, the housing 9 is exposed to flowing water and can be optimally cooled there in order to make the impermissible heating of the batteries 5 and 6 during operation nearly impossible. If the user lies prone on the hull 10 of the craft, the user can hold onto grip elements 7 or gripping depressions. Operating elements of a manual control device 14 have been integrated into one or both grip elements 7.

A wireless remote control device 4' can also be provided and connected with the motor control device 4 via a radio connection. The manual control device 14, which communicates with the motor control device 4, is maintained on the hull 10 of the craft in the field of view of the user. If the user stands on the hull 10 of the craft, the manual control device 14 can be released from the hull 10 of the craft and used. Various operational states, for example the actual speed, the diving depth or the charge state of the batteries 5, 6 can be displayed on it.

The electric motor is designed as an internal rotor motor and is installed directly in the flow channel 8 and releases its heat there to the flowing water, which will be explained in greater detail later in this specification.

The motor control device, which can contain the electronic power elements and/or a microprocessor, can also be arranged in the flow channel 8 and cooled there. Alternatively, the motor control device 4 can also be arranged in the water outside the flow channel 8.

Figure 2:
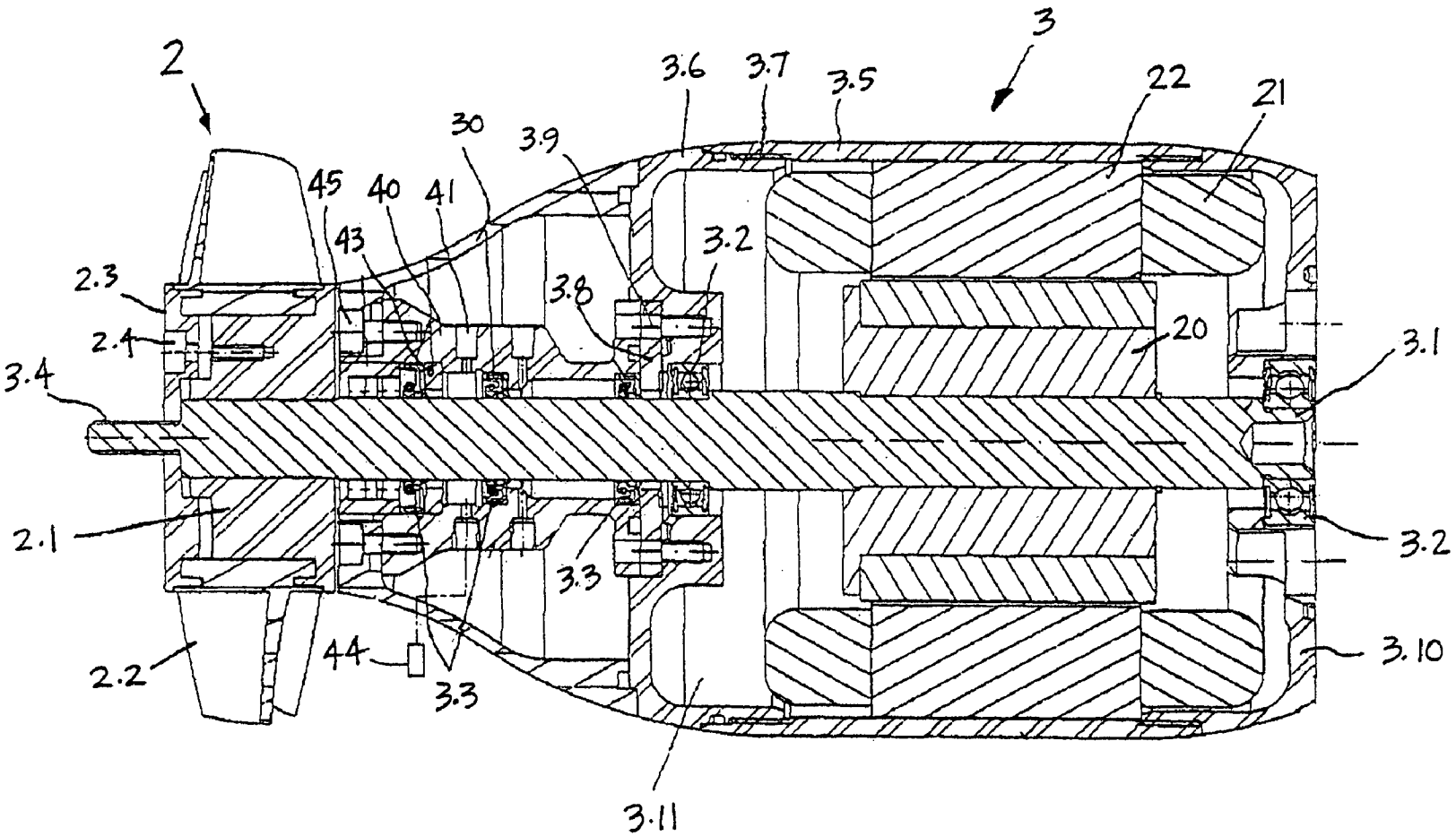
FIG. 2 shows a sectional side view of an electric motor of the motorized watercraft.

The electric motor 3 is shown in detail in FIG. 2. In accordance with this embodiment, the electric motor 3 has a driveshaft 3.1, which is seated by two bearings 3.2. On one shaft end the driveshaft 3.1 has a seating section, on which the water screw 2 is mounted. The water screw 2 is held here on the driveshaft 3.1 by its base body 2.1. The base body 2.1 has plug-in openings into which the propeller blades 2.2 are inserted. A cover 2.3 is used for fixing the propeller blades 2.2 in the plug-in openings. The cover is screwed to the base body 2.1, such as with a screw connection 2.4.

On its end, the driveshaft 3.1 has a threaded section 3.4 on which a nut can be placed and the water screw 2 can thus be fixed in place.

The driveshaft supports a rotor 20 of the drive motor embodied as an internal rotor. A stator 21, which is fixed in place, is assigned to it. With a heat-conducting unit 22 in the form of a casting compound, the stator 21 is cast together with the interior wall of the receiving housing 3.5.

The receiving housing 3.5 can be closed off by a housing cover 3.10 arranged on the side of the driveshaft 3.1 facing away from the water screw 2. On the side facing away from the housing cover 3.10, a housing element 3.6 closes the receiving housing 3.5 off, such as with a screw connection 3.7. The housing cover 3.10 and the housing element 3.6 have seating receptacles for the two bearings 3.2.

A stator receiver 3.11 is formed in the receiving housing 3.5 and extends over a greater area than the area covered by the stator 21. This construction permits the installation of larger stators 21, and rotors 20, to accommodate different power variations.

A parts housing 30 is placed in a bell-like manner over the driveshaft 3.1 in the area of the housing element 3.6. A sealing cassette 40 is arranged in the space enclosed by the parts housing 30. The cassette encloses the driveshaft 3.1 and seals it with three sealing rings 3.3, such as radial shaft sealing rings. The sealing cassette 40 is sealingly connected with the housing element 3.6 with the interposition of a spacer 3.8, such as a screw connection 3.9. The parts housing is sealingly connected with the receiving housing 3.5. For this purpose, the parts housing 30 is clamped together with the sealing cassette 40, such as a screw connection 45.

As shown in FIG. 2, spaces are arranged between the sealing rings 3.3 into which sensors 44, which can be mounted in sensor receptacles 41, project. They detect water entering in case of a leak.

To prevent penetration of the sealing rings 3.3 in the associated running surface of the driveshaft 3.1, the spacer 3.8 can be replaced by a spacer 3.8 of a different thickness after a defined period of operation. In that case the sealing rings 3.3 reach an unused area of the shaft. As FIG. 2 shows, it is also possible to only shift the sealing ring 3.3 facing the water screw 2, such as with a spacer 43.

German Patent References 100 09 197.0 and 100 09 278.0, the priority documents corresponding to this invention, and their teachings are incorporated, by reference, into this specification.

What is claimed is:

1. A motorized watercraft having a hull of the watercraft on which a user lies prone, at least partially, or stands up, with a flow channel extending in the hull with an electric motor-driven water screw, wherein an electric motor, and a control device for the electric motor and the water screw are housed, at least partially, in the flow channel in the hull, the motorized watercraft comprising:

a battery positioned in a waterproof housing (9) disposed adjacent the flow channel and in contact with flowing water in the flow channel;

a flow stator (1) arranged in the flow channel (8) downstream of the water screw (2) in a flow direction, straightening a rotating water flow generated in the flow channel, at least partially.

2. The motorized watercraft in accordance with claim 1, wherein the flow stator (1) is connected with the hull (10) of the watercraft and fixed in place.

3. The motorized watercraft in accordance with claim 2, wherein the flow stator (1) has a plurality of guide vanes concentrically arranged in the flow channel (8).

4. The motorized watercraft in accordance with claim 3, wherein the flow stator (1) is arranged near a water outlet nozzle having a tapered cross section of the flow channel (8).

5. The motorized watercraft in accordance with claim 1, wherein the flow stator (1) has a plurality of guide vanes concentrically arranged in the flow channel (8).

6. The motorized watercraft in accordance with claim 1, wherein the flow stator (1) is arranged near a water outlet nozzle having a tapered cross section of the flow channel (8).

7. The motorized watercraft in accordance with claim 1, wherein the housing (9) with the battery is arranged in a recess (13) formed on an underside of the hull (10) of the craft which is arranged, at least partially, outside of the flow channel (8) and of an inlet opening (11) of the flow channel (8), and the housing (9) is exposed to flowing water on at least one of a port side, a starboard side and a keel side.

8. The motorized watercraft in accordance with claim 1, wherein the flow channel (8) is formed in one piece with the hull (10) of the craft.

9. The motorized watercraft in accordance with claim 1, wherein the flow channel (8) begins with an inlet opening (11) near a bow of the hull (10) and terminates in an outlet opening (12) near a stern of the hull (10), and an underwater drive unit is installed in the flow channel (8) as a propelling and suction device.

10. The motorized watercraft in accordance with claim 1, wherein a remote control device (4') is assigned to an underwater drive unit, which is releasably attached to the hull (10) of the craft and is operatively contactable with the control device (4) of the underwater drive unit over a wireless transmission path.

11. The motorized watercraft in accordance with claim 1, wherein the hull (10) of the craft has one of a plate and a flap which is openable in the flow channel below the underwater drive unit, through which access to the underwater drive unit is provided.

12. The motorized watercraft in accordance with claim 1, wherein the water screw (2), the electric motor (3) and the control device (4) are embodied as an underwater drive unit and are housed in the flow channel (8), and the batteries (5, 6) are positioned in a separate housing (9) which is one of fixedly and exchangeably installed in the hull (10) of the vehicle.

13. A motorized watercraft having a hull of the watercraft on which a user lies prone, at least partially, or stands up, with a flow channel extending in the hull with an electric motor-driven water screw, wherein at least one of an electric motor, and a control device for the electric motor and the water screw are housed, at least partially, in the flow channel in the hull, the motorized watercraft comprising:

a battery positioned in a waterproof housing (9) and in heat-conducting contact with the housing (9), at least partially, the housing (9) of a heat-conductive material, at least partially, and the housing (9) in heat-conducting contact with the flowing water;

wherein the housing (9) is arranged in a recess (13) formed on an underside of the hull (10) of the craft which is arranged, at least partially, outside of the flow channel (8) and of an inlet opening (11) of the flow channel (8), and the housing (9) is exposed to flowing water on at least one of a port side, a starboard side and a keel side.

14. The motorized watercraft in accordance with claim 13, wherein the housing (9) is at least partially of aluminum.

15. The motorized watercraft in accordance with claim 14, wherein the batteries (5, 6) have a voltage of less than or equal to 60 V.

16. The motorized watercraft in accordance with claim 15, wherein the housing (9) is arranged at least partially near the flow channel (8).

17. The motorized watercraft in accordance with claim 13, wherein the housing (9) extends around a center area of the hull (10) between a bow and a stern in a direction toward the bow.

18. The motorized watercraft in accordance with claim 17, wherein the housing (9) is exchangeably connected with the hull (10) of the vehicle.

19. The motorized watercraft in accordance with claim 13, wherein the batteries (5, 6) have a voltage of less than or equal to 60 V.

20. The motorized watercraft in accordance with claim 13, wherein the housing (9) is arranged at least partially near the flow channel (8).

21. The motorized watercraft in accordance with claim 13, wherein the housing (9) extends around a center area of the hull (10) between a bow and a stern in a direction toward the bow.

22. The motorized watercraft in accordance with claim 13, wherein the housing (9) is exchangeably connected with the hull (10) of the vehicle.

23. The motorized watercraft in accordance with claim 13, wherein the flow channel (8) is formed in one piece with the hull (10) of the craft.

24. The motorized watercraft in accordance with claim 13, wherein the flow channel (8) begins with an inlet opening (11) near a bow of the hull (10) and terminates in an outlet opening (12) near a stern of the hull (10), and an underwater drive unit is installed in the flow channel (8) as a propelling and suction device.

25. The motorized watercraft in accordance with claim 13, wherein a remote control device (4') is assigned to an underwater drive unit, which is releasably attached to the hull (10) of the craft and is operatively contactable with the control device (4) of the underwater drive unit over a wireless transmission path.

26. The motorized watercraft in accordance with claim 13, wherein the hull (10) of the craft has one of a plate and a flap which is openable in the flow channel below the underwater drive unit, through which access to the underwater drive unit is provided.

27. The motorized watercraft in accordance with claim 13, wherein the water screw (2), the electric motor (3) and the control device (4) are embodied as an underwater drive unit and are housed in the flow channel (8), and the battery is positioned in a separate housing (9) which is one of fixedly and exchangeably installed in the hull (10) of the vehicle.

28. A motorized watercraft having a hull of the watercraft on which a user lies prone, at least partially, or stands up, with a flow channel extending in the hull with an electric motor-driven water screw, wherein at least one of an electric motor, and a control device for the electric motor and the water screw are housed, at least partially, in the flow channel in the hull, the motorized watercraft comprising:

the electric motor (3) including a rotor supported on a driveshaft connected to the water screw;

a stator (21) disposed around the rotor and attached in heat-conducting contact with an interior wall of a receiving housing (3.5) containing the electric motor (3) via a heat-conducting unit (22);

the receiving housing (3.5) at least partially of a heat-conductive material in an area of the heat-conducting unit (22); and the receiving housing (3.5) arranged at least partially in the flow channel (8).

29. The motorized watercraft in accordance with claim 28, wherein the heat-conducting unit (22) is designed as a heat-conducting casting compound which is connected with the receiving housing (3.5) by material contact.

30. The motorized watercraft in accordance with claim 29, wherein a motor housing of the electric motor (3) forms a stator receiver (3.11), in which is installed one of different stators (21) having different lengths in an axial direction of the driveshaft (3.1) of the rotor (20) and having different power ranges.

31. The motorized watercraft in accordance with claim 30, wherein the rotor (20) and the stator (21) are placed in the receiving housing (3.5) which is watertight with respect to an environment, the driveshaft (3.1) extends out of the receiving housing (3.5) through a sealing cassette (40), the sealing cassette (40) seals the driveshaft (3.1) by at least two sealing rings (3.3) and the sealing cassette (40) is displaceable in the axial direction into different mounting positions with respect to the driveshaft (3.1).

32. The motorized watercraft in accordance with claim 31, wherein a running surface of the driveshaft (3.1) on which sealing rings (3.3) run off is tempered.

33. The motorized watercraft in accordance with claim 32, wherein a leak sensor is arranged one of between two of the sealing rings 3.3 and downstream of two of the sealing rings 3.3.

34. The motorized watercraft in accordance with claim 28, wherein the flow channel (8) is formed in one piece with the hull (10) of the craft.

35. The motorized watercraft in accordance with claim 34, wherein the flow channel (8) begins with an inlet opening (11) near the bow of the hull (10) and terminates in an outlet opening (12) near the stern of the hull (10), and the underwater drive unit is installed in the flow channel (8) as a propelling and suction device.

36. The motorized watercraft in accordance with claim 35, wherein a remote control device (4') is assigned to the underwater drive unit, which is releasably attached to the hull (10) of the craft and is operatively contactable with the control device (4) of the underwater unit over a wireless transmission path.

37. The motorized watercraft in accordance with claim 36, wherein the hull (10) of the craft has one of a plate and a flap which is openable in the flow channel below the underwater drive unit, through which access to the underwater unit is provided.

38. The motorized watercraft in accordance with claim 37, wherein the water screw (2), the electric motor (3) and the control device (4) are embodied as an underwater drive unit and are housed in the flow channel (8), and the batteries (5, 6) are positioned in a separate housing (9) which is one of fixedly and exchangeably installed in the hull (10) of the vehicle.

39. The motorized watercraft in accordance with claim 28, wherein a motor housing of the electric motor (3) forms a stator receiver (3.11), in which is installed one of different stators (21) having different lengths in an axial direction of the driveshaft (3.1) of the rotor (20) and having different power ranges.

40. The motorized watercraft in accordance with claim 28, wherein the rotor (20) and the stator (21) are placed in the receiving housing (3.5) which is watertight with respect to an environment, the driveshaft (3.1) extends out of the receiving housing (3.5) through a sealing cassette (40), the sealing cassette (40) seals the driveshaft (3.1) by at least two sealing rings (3.3), and the sealing cassette (40) is displaceable in the axial direction into different mounting positions with respect to the driveshaft (3.1).

* * * * *